US008052480B2

(12) United States Patent
Hauser

(10) Patent No.: US 8,052,480 B2
(45) Date of Patent: Nov. 8, 2011

(54) PENTAGON ARRANGEMENT OF MULTIPLE PIN CONNECTORS

(75) Inventor: Timothy Glenn Hauser, Fort Wayne, IN (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 162 days.

(21) Appl. No.: 12/370,630

(22) Filed: Feb. 13, 2009

(65) Prior Publication Data

US 2010/0210147 A1 Aug. 19, 2010

(51) Int. Cl.
*H01R 13/625* (2006.01)

(52) U.S. Cl. ..... 439/672

(58) Field of Classification Search ..... 439/660, 439/670, 672, 700, 335
See application file for complete search history.

(56) References Cited

U.S. PATENT DOCUMENTS 3,008,116 A * 11/1961 Blanchenot ..... 439/317
4,176,898 A * 12/1979 Marechal ..... 439/139
7,405,473 B1 * 7/2008 Shi et al. ..... 257/698
7,537,489 B2 * 5/2009 Iranpour Feridani et al. 439/660

* cited by examiner

*Primary Examiner* — Vanessa Girardi
(74) *Attorney, Agent, or Firm* — Edell, Shapiro & Finnan, LLC

(57) ABSTRACT

A connector for electrically connecting an electronic device to another device includes an outer shell with a front surface that terminates at a front side of the connector, an inner core at least partially disposed within the outer shell and including a front surface that is recessed within the outer shell, and a plurality of electrical connecting elements at least partially disposed within the inner core and extending from the front surface of the inner core. The plurality of electrical connecting elements includes a first set of electrical connecting elements and a second set of at least one electrical connecting element, and the first set of electrical connecting elements includes five connecting elements that are arranged in a pentagon pattern. The connector facilitates the transmission of audio signals between devices and also additional analog or digital signals or the transmission of a power supply between the devices.

22 Claims, 5 Drawing Sheets

PENTAGON ARRANGEMENT OF MULTIPLE PIN CONNECTORS

FIELD OF THE INVENTION

The invention relates to connectors that facilitate electrical connections between electronic devices and auxiliary devices.

BACKGROUND

Audio connectors for electronic devices used in military or other government sectors are typically designed with five or six electrical contact pins and must also meet the MIL-DTL-55116 specifications as designated by the U.S. government. Audio connectors include receptacle connectors and plug connectors. The audio receptacle connectors are connected on an outer front or other surface of the electronic device (e.g., a military radio) and connect with corresponding plug connectors that connect (e.g., via a cable) to an auxiliary device such as a phone handset or headset to facilitate the transfer of audio signals between the two devices.

A six pin audio receptacle connector that meets MIL-DTL-55116 specifications is depicted in FIG. 1. A receptacle connector 2 includes an outer shell 4 and an inner core 6 including six spring-loaded, electrical contact pins 8 which are disposed within and extend from the core. Five of the contact pins 8 are aligned in a geometric pattern of a pentagon, where the five contact pins are located at points at which imaginary lines forming the pentagon pattern intersect. As used in the specification and claims, the term "pentagon" refers to a regular pentagon or a five-sided polygon in which the intersecting lines forming the sides of the pentagon have equal lengths. The sixth pin 8 is disposed at a central location within the pentagon pattern formed by the five contact pins 8. The five pin receptacle connector meeting MIL-DTL-55116 specifications is substantially similar in design as the six pin receptacle connector with the exception that central contact pin does not exist in the five pin receptacle connector.

The outer shell 4 of the connector 2 includes a plurality of J-shaped slots or J-slots 10 which are aligned to engage with corresponding bayonet pins 48 disposed on an interior surface portion of the shell 42 of a corresponding plug connector 40 as depicted in FIG. 2. Plug connector 40 includes an inner core 44 recessed within the outer shell 42. The inner core 44 includes six electrical convex bump contacts 46 disposed on the inner core and having the same basic configuration as the contact pins 8. It is noted that, for five pin receptacle connectors, corresponding plug connectors would typically include five bump contacts. Plug connector 40 connects with receptacle connector 2 by inserting the connector shell 42 over the shell 4 of connector 2 and rotating the plug connector (e.g., in a clockwise direction) with respect to the receptacle connector to lock the bayonet pins 48 within J-slots 10, which results in mating of the inner shells of each connector and alignment, engagement and electrical contact of the contact pins 8 with the corresponding bump contacts 46 so as to facilitate transfer of electrical signals between the electrical devices to which the connectors are attached.

It is desirable to provide a connector meeting MIL-DTL-55116 specifications and which is further configured to transfer additional signals or provide further functionality in addition to the transfer of audio signals between electronic devices.

SUMMARY

In accordance with the present invention, a connector is provided that facilitates an electrical connection between an electronic device and another device.

In one embodiment, the connector comprises an outer shell including a front surface that terminates at a front side of the connector, the front side of the connector being configured to mate with another connector, an inner core at least partially disposed within the outer shell and including a front surface that is recessed within the outer shell, and a plurality of electrical connecting elements at least partially disposed within the inner core and extending from the front surface of the inner core. The plurality of electrical connecting elements includes a first set of electrical connecting elements and a second set of at least one electrical connecting element, and the first set of electrical connecting elements comprises five connecting elements arranged in a pentagon pattern where each connecting element is located at a point defined by two intersecting lines of the pentagon pattern.

In accordance with another embodiment of the invention, a method of connecting a first connector with a second connector is provided, where the first connector comprises an outer shell including a front surface that terminates at a front side of the first connector, an inner core at least partially disposed within the outer shell and including a front surface that is recessed within the outer shell, and a plurality of electrical contact pins at least partially disposed within the inner core and extending from the front surface of the inner core, the plurality of electrical contact pins including a first set of contact pins and a second set of at least one contact pin, the first set of contact pins comprising five contact pins arranged in a pentagon pattern where each contact pin is located at a point defined by two intersecting lines of the pentagon pattern, and the second connector comprises an outer shell including a front surface that terminates at a front side of the second connector, an inner core at least partially disposed within the outer shell and including a front surface that is recessed within the outer shell, and a plurality of electrical convex bump contacts at least partially extending from the front surface of the inner core, the plurality of electrical convex bump contacts including a first set of bump contacts, the first set of bump contacts comprising five bump contacts arranged in a pentagon pattern where each bump contact is located at a point defined by two intersecting lines of the pentagon pattern. The method comprises inserting the front side of the outer shell of the first connector into the outer shell of the second connector, aligning the second connector with the first connector such that the pentagon pattern of bump contacts of the second connector is offset from the pentagon pattern of contact pins of the first connector, and rotating the second connector in relation to the first connector to mate the connectors together and engage each contact pin of the first connector with a corresponding bump contact of the second connector. Each contact pin of the first connector engages and achieves an electrical contact with only the corresponding bump contact and no other bump contact of the second connector during rotational movement of the second connector to achieve mating between the first and second connectors.

The connector of the present invention includes a number of useful features including, without limitation, additional functionalities in relation to conventional audio connectors meeting MIL-DTL-55116 specifications while also enabling connections with standard five or six pin audio plug connectors.

The above and still further features and advantages of the present invention will become apparent upon consideration of the following detailed description of a specific embodiment thereof, particularly when taken in conjunction with the accompanying drawings wherein like reference numerals in the various figures are utilized to designate like components.

DETAILED DESCRIPTION

In accordance with the present invention, electrical connectors are provided that facilitate electrical connections between an electronic device and one or more different auxiliary devices that connect with the electronic device. An electrical receptacle connector is connected with the electrical device to facilitate connection with a corresponding plug connector connected with a cable or other device so as to permit exchange of analog and/or digital signals (e.g., audio or radio signals, communication and/or control signals) and/or the transfer of electrical power between the electronic device and the auxiliary device connected to the electronic device.

The connectors of the present invention are particularly suited for use as modified connectors of the conventional five or six pin audio connector configured to meet the MIL-DTL-55116 specifications as designated by the U.S. government. The connectors of the present invention include one or more additional electrical contacts (e.g., additional contact pins and/or contact bumps) to facilitate the transfer of additional signals using the connectors.

Figure 1:
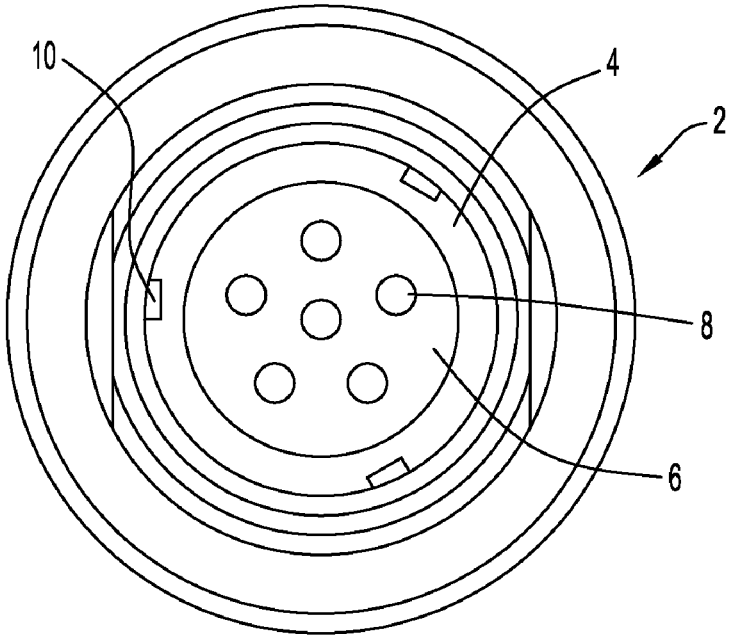
FIG.1 PRIOR ART
FIG. 1 is a view in plan of a conventional six pin audio receptacle connector.

In particular, the connectors of the present invention can have a configuration that is a modification of a five or six pin audio receptacle connector such as previously described and depicted in FIG. 1, where the receptacle connector includes at least one more additional pin, preferably at least five contact pins, arranged in a suitable manner that facilitates use of the receptacle connector with a corresponding audio plug connector including five or six electrical contact bumps and also use of the receptacle connector with other plug connectors including electrical contact bumps that correspond with the number of contact pins of the connector.

The connectors of the present invention are suitable for use with a number of different electronic devices, in particular military radios and other military electronic equipment that require audio connectors meeting MIL-DTL-55116 specifications.

Figure 3:
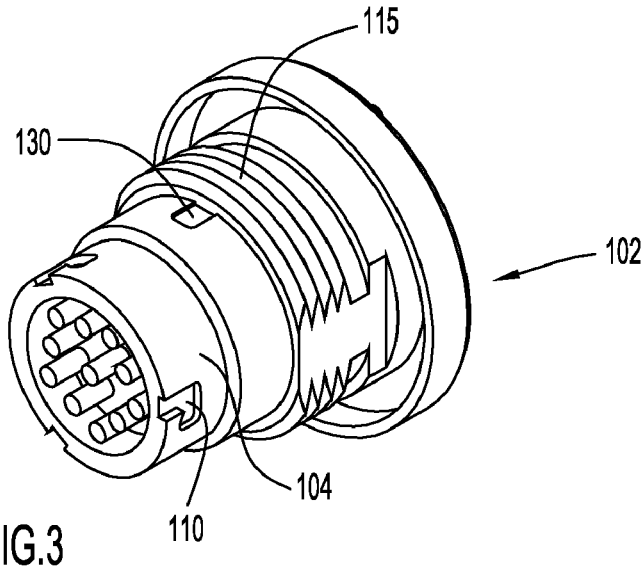
FIG. 3 is a perspective view including the front side of an example embodiment of a receptacle connector of the present invention.
Figure 4:
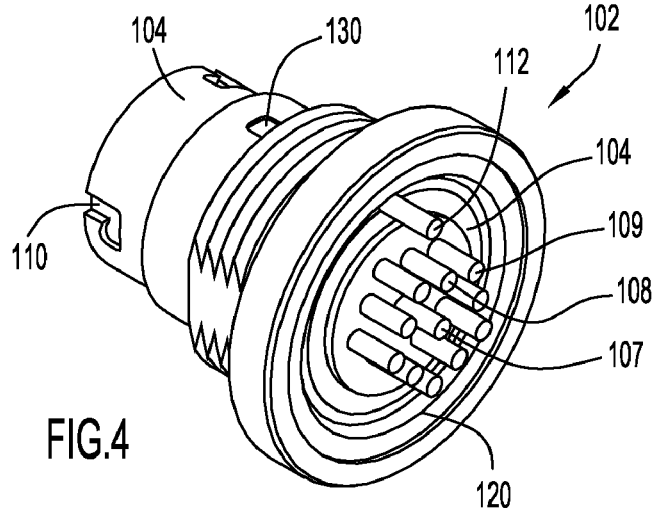
FIG. 4 is a perspective view including the rear side of the receptacle connector of FIG. 3.
Figure 5:
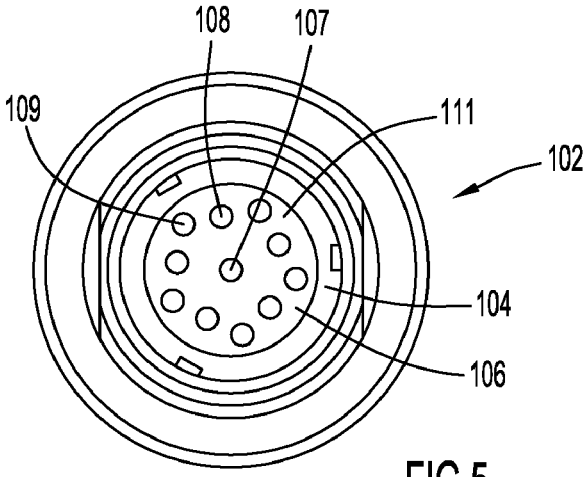
FIG. 5 is a view in plan of the front side of the receptacle connector of FIG. 3.

Example embodiments of a receptacle connector and corresponding plug connector of the present invention that include an eleven electrical contact configuration are depicted in FIGS. 3-8. Referring to FIGS. 3-5, a receptacle connector 102 includes an outer shell 104 and an inner core 106 disposed within the shell. The inner core 106 includes a front surface or side 111 that is recessed a slight distance from a front end of the outer shell 104. Eleven electrical contact pins 107, 108, 109 are disposed within and extend in a longitudinal direction of the connector and protrude from the front side 111 of the inner core 106.

The outer shell can be constructed of any suitably rigid materials, such as stainless steel, while the inner core is preferably constructed of a suitable insulator polymer or plastic material such as a molded resin (e.g., polybutylene terephthalate). The electrical contact pins are constructed of a suitable electrically conductive material such as copper or a copper alloy which may be plated with any one or more of gold, tin or nickel.

Figure 5A:
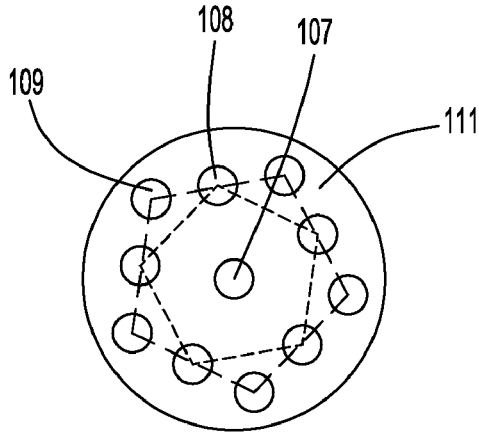
FIG. 5A is a view in plan of the front side of the inner core of the receptacle connector of FIG. 3, with dashed lines drawn between contact pins of the first and second sets.

The electrical contact pins of the receptacle connector 102 include a first set of contact pins and a second set of contact pins. The first set of contact pins includes six contact pins 107, 108 that are aligned in a manner similar to the embodiment depicted in FIG. 1. In particular, five contact pins 108 of the first set are aligned in a geometric pattern of a pentagon, where the five contact pins are located at points at which imaginary lines forming the pentagon pattern intersect, with a sixth pin 107 of the first set being disposed at a central location within the pentagon pattern formed by the five contact pins 108 (see FIG. 5A, which shows the inner core with dashed lines showing the formation of pentagon patterns with the contact pins).

The second set of contact pins includes five pins 109 that are arranged in the core 106 such that each additional pin 109 is aligned between two contact pins 108 but at a greater radial distance from the central pin 107 and also the center of the inner core in relation to any of contact pins 108. The five contact pins 109 of the second set are also aligned in a geometric pattern of a pentagon, where the five contact pins are located at points at which imaginary lines forming the pentagon pattern intersect (see FIG. 5A). The pentagon pattern formed by contact pins 109 of the second set is offset (e.g., rotated clockwise) in relation to the pentagon pattern formed by contact pins 108 of the first set.

Some or all of the contact pins 107, 108, 109 have a spring loaded configuration in which the pin is spring biased outward from the front side 111 of the inner core 106 but is movable a predetermined distance into the inner core (i.e., movable in a longitudinal direction of the inner core), for example, upon engagement with a bump contact of a corresponding plug connector. For example, each of contact pins 107, 108 of the first set can be spring biased in this manner, while contact pins 109 of the second set are fixed and non-movable with respect to the inner core 106. Alternatively, all of the contact pins 107, 108, 109 can be spring biased to move into or out of the inner core 106. Any other combination of spring loaded and fixed contact pins can also be provided for the receptacle connector. The spring mechanism for each pin is disposed within the core 106 and can be the same or substantially similar to a spring loaded contact pin for audio connectors meeting MIL-DTL-55116 specifications.

Referring to FIG. 4, the inner core 106 extends through the outer shell 104 to a rear side 120 of the receptacle connector 102. The receptacle connector 102 is secured to a device at its rear side 120. The contact pins 107, 108, 109 are coupled with electrical contact pins (e.g., the contact pins extend through the rear side of the inner core or connect with other contacts which extend from the rear side of the core) so as to extend from the rear side 120 and a slight distance beyond the outer shell, which facilitates engagement with corresponding electrical contacts disposed within the device to which the connector is secured. A ground contact pin 112 can also provided at the rear side of the connector as shown in FIG. 4. The ground contact pin 112 extends from the outer shell. Alternatively, it is noted that one or more individual contact pins can also be grounded to the shell and/or filtered, depending upon a particular application.

A plurality (e.g., three) J-shaped grooves or J-slots 110 are disposed along an outer periphery and near the front side of the outer shell 104 at circumferentially spaced locations from each other. Each J-shaped slot 110 includes a first portion extending along the outer periphery from the front side and in a longitudinal direction of the outer shell 104 to a second portion that extends along the outer periphery of the outer shell in a direction transverse and at a suitable angle (e.g., about 90°) to the first portion. The J-slots 110 are suitably aligned along the outer shell 104 and suitably dimensioned to engage with corresponding bayonet pins disposed on a plug connector that connects with connector 102 (as described below).

The outer shell 104 of receptacle connector 102 has a generally cylindrical configuration with a stepped outer contour and increasing external dimensions in a direction from the front side to the rear side or base of the connector (as shown in FIGS. 3 and 4). Connector 102 includes a threaded portion 115 near its base that can be configured to connect the receptacle connector with an electronic device such that the front side of the outer shell 104 including J-slots 110 extends from the device to facilitate connection with a plug connector.

Figure 6:
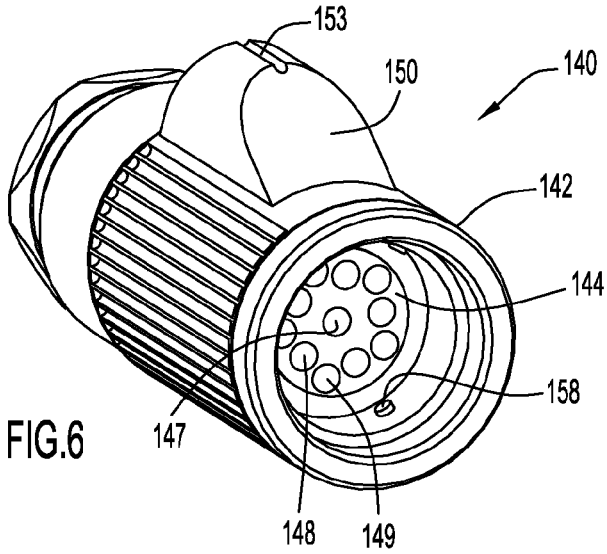
FIG. 6 is a perspective view including the front side of an example embodiment of a plug connector of the present invention which connects with the receptacle connector of FIG. 3.
Figure 7:
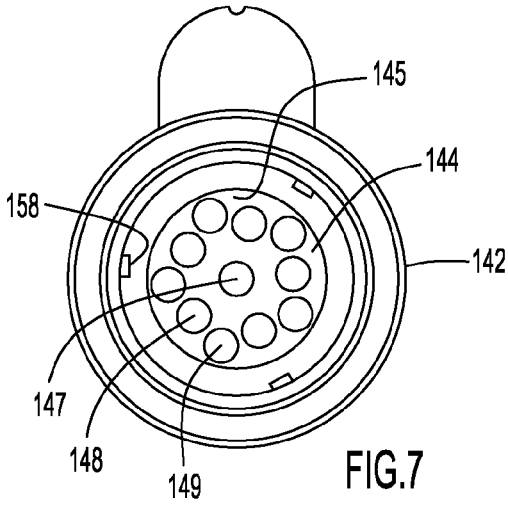
FIG. 7 is a view in plan of the front side of the plug connector of FIG. 6.

A plug connector 140 which mates or connects with connector 102 is depicted in FIGS. 6 and 7. Plug connector 140 includes an outer shell 142 and an inner core 144 recessed within the outer shell such that a front side 145 of the inner core is a suitable distance from the front side of the outer shell. The outer shell can be constructed of any suitable rigid materials, such as stainless steel, while the inner core is preferably constructed of a suitable insulator polymer or plastic material such as a molded resin (e.g., polybutylene terephthalate).

Figure 7A:
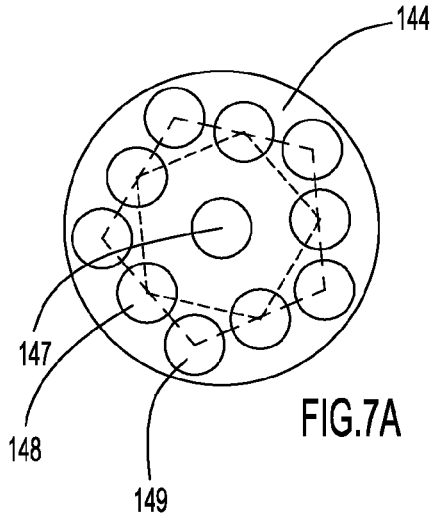
FIG. 7A is a view in plan of the front side of the inner core of the plug connector of FIG. 6, with dashed lines drawn between bump contacts of the first and second sets.

The inner core 144 includes eleven convex electrical bump contacts 147, 148, 149 that are aligned along the front side of the inner core in a geometric configuration that is substantially similar to the alignment of contact pins 107, 108, 109 along the front side 111 of the inner core 106 of receptacle connector 102. In particular, a first set of bump contacts includes five bump contacts 148 that are aligned in a geometric pattern of a pentagon, where the five bump contacts are located at points at which imaginary lines forming the pentagon pattern intersect, with a sixth bump contact 147 of the first set being disposed at a central location within the pentagon pattern formed by the five bump contacts 148 (see FIG. 7A, which shows the inner core with dashed lines showing the formation of pentagon patterns with the bump contacts). A second set of bump contacts includes five bump contacts 149 that are arranged on the front side 145 of core 144 such that each additional bump contact 149 of the first set is aligned between two bump contacts 148 of the second set but at a greater radial distance from the central bump contact 147 and also the center of the inner core than any of bump contacts 148. The five bump contacts 149 of the second set are also aligned in a geometric pattern of a pentagon, where the five bump contacts are located at points at which imaginary lines forming the pentagon pattern intersect (see FIG. 7A). The pentagon pattern formed by bump contacts 149 of the second set is offset (e.g., rotated clockwise) in relation to the pentagon pattern formed by bump contacts 148 of the first set.

The electrical bump contacts are constructed of a suitable electrically conductive material such as copper or a copper alloy which may be plated with any one or more of gold, tin or nickel. The bump contacts 147, 148, 149 of the plug connector 140 are coupled with electrical connections that extend through the inner core to a rear side of the plug connector to facilitate connection with electrical contacts of an auxiliary device.

Like the contact pins of the receptacle connector, some or all of the bump contacts can also have a spring loaded configuration in which the bump contact is spring biased outward from the front side 145 of the inner core 144 but is movable a predetermined distance into the inner core (i.e., movable in a longitudinal direction of the inner core). The bump contacts of the plug connector can also have other configurations that facilitate engagement and making electrical contact with the contact pins of the receptacle connector.

The outer shell 142 of the plug connector 140 includes a plurality of bayonet pins 158 (e.g., three bayonet pins) disposed along an internal periphery of the outer shell between the front side 145 of the inner core 144 and the front end of the outer shell. The bayonet pins 158 are further spaced from each other and suitably aligned and dimensioned to engage with the J-slots disposed along the outer shell 104 of receptacle connector 102 when the plug connector 140 mates with the receptacle connector 102.

The outer shell 142 of the plug connector 140 has a generally cylindrical configuration and includes an alignment indicator in the form of a raised portion 150 with a notch 153 extending along the raised portion, where the raised portion 150 is disposed along an outer peripheral portion of the outer shell. It is noted that an alignment indicator can also be provided without a raised portion (e.g., providing a mark or other indicia to serve as the alignment indicator). The outer shell 104 of connector 102 can also include an alignment indicator along its outer periphery (e.g., in the form of notch 130 and/or a colored line as shown in FIGS. 3 and 4) to facilitate proper alignment and connection of the plug connector with the connector by aligning the alignment indicators during mating of the two connectors.

Connection of the receptacle connector with the plug connector is achieved by fitting outer shell 142 over outer shell 104 and aligning the bayonet pins 158 of the plug connector 140 with the corresponding J-slots 110 of the receptacle connector 102 (which can be easily enabled using the alignment indicators 153 and 130 of the connectors). The plug connector 140 is pushed toward receptacle connector 102 and then rotated slightly (e.g., in a clockwise direction) so that the bayonet pins 158 engage with and are seated in a locking relationship with J-slots 110.

Figure 8:
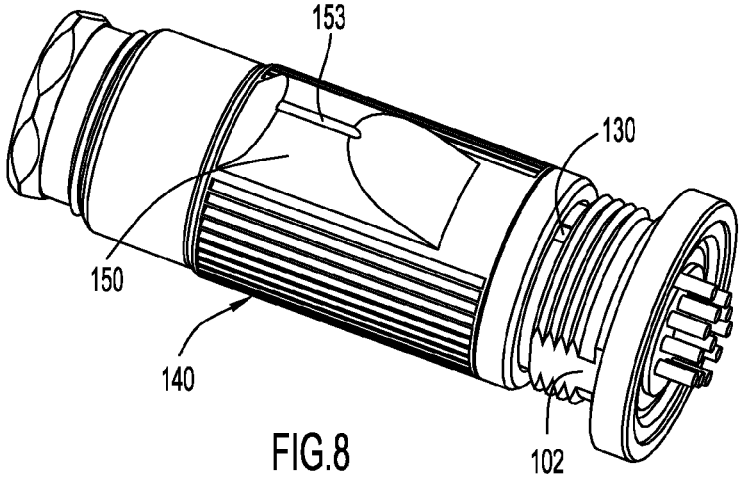
FIG. 8 is a view in perspective of the receptacle connector of FIG. 3 and the plug connector of FIG. 6 mated together.
Figure 9:
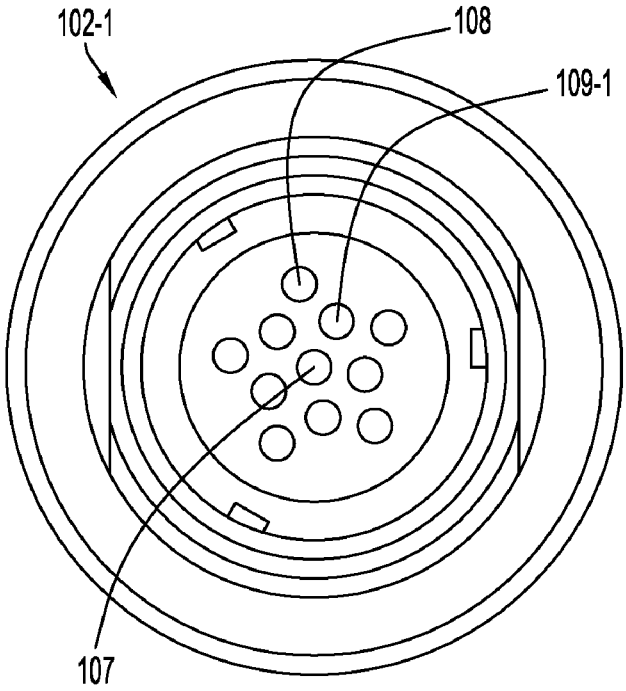
FIG. 9 is a view in plan of the front side of another example embodiment of a receptacle connector in accordance with the present invention.
Figure 9A:
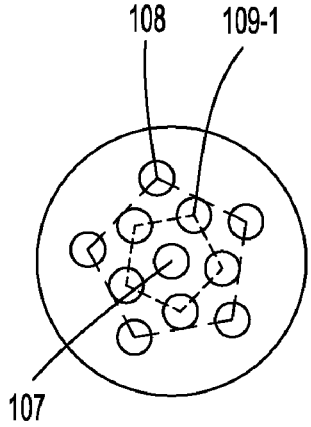
FIG. 9A is a view in plan of the front side of the inner core of the receptacle connector of FIG. 9, with dashed lines drawn between contact pins of the first and second sets.
Figure 10:
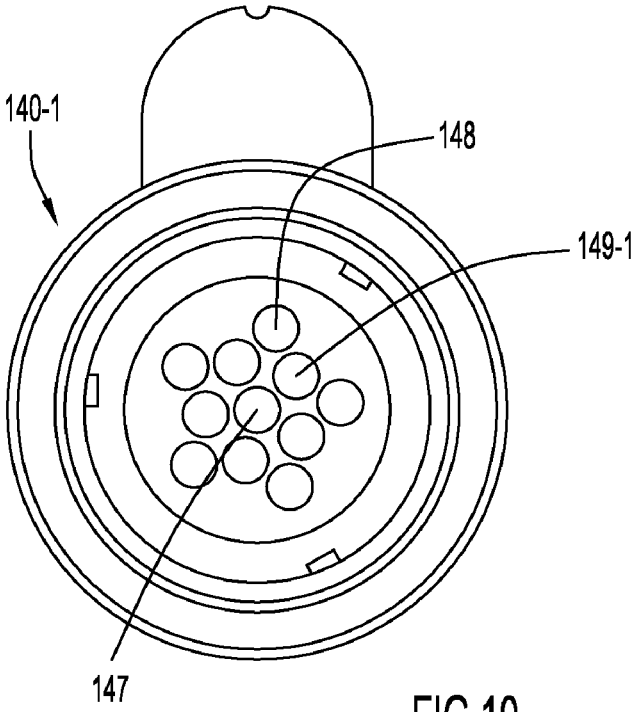
FIG. 10 is a view in plan of the front side of another example embodiment of a plug connector in accordance with the present invention which connects with the receptacle connector of FIG. 9.
Figure 10A:
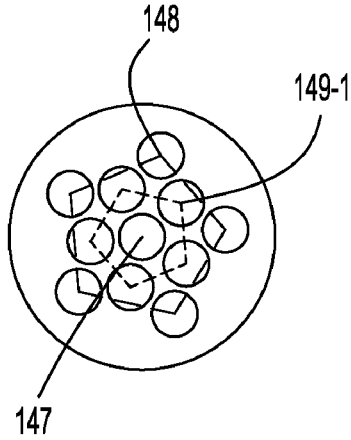
FIG. 10A is a view in plan of the front side of the inner core of the plug connector of FIG. 10, with dashed lines drawn between bump contacts of the first and second sets.

When the plug connector 140 is aligned to connect with the receptacle connector 102 at the point at which the bayonet pins 158 initiate entry into J-slots 110, the geometric configuration of bump contacts 147, 148, 149 is offset by an angle of rotation (e.g., about 13°) from the geometric configuration of contact pins 107, 108, 109. During rotation of the bayonet pins in the J-slots, the bump contacts rotate with plug connector 140 so as to eventually make sliding contact with their corresponding contact pins as the bayonet pins become locked within the J-slots. As noted above, when the receptacle connector 102 includes spring loaded contact pins, these spring loaded contact pins are forced inward slightly into inner core 106 as their corresponding bump contacts slide into engagement with these contact pins. When the bayonet pins are locked within the J-slots and receptacle connector 102 is mated with plug connector 140, as shown in FIG. 8, the bump contacts 147, 148, 149 of plug connector 140 are engaged with their corresponding contact pins 107, 108, 109 of receptacle connector 102.

The design of the connectors of the present invention facilitates the addition of a plurality of pins/bump contacts to enhance the functionality of the audio connectors while ensuring that no electrical shorting of any pins occurs during the mating connection of the connectors. In particular, the location, orientation and cross-sectional dimensions of the pins/bump contacts are suitably selected such that no contact (i.e., contact pin of the connector or bump contact of the plug connector) engages another contact apart from its corresponding contact during rotation of the plug connector with the receptacle connector in the mating connection. Thus, in the embodiment described above and depicted in FIGS. 3-8, when bump contacts 147, 148, 149 move with respect to contact pins 107, 108, 109 in response to rotation of the plug connector 140 in relation to the receptacle connector 102, the bump contacts do not make contact with any contact pin other than the corresponding contact pin to which the bump contact ultimately engages with at the end of the rotational movement of the plug connector.

In addition, the receptacle connector with additional contact pins (e.g., nine pins, ten pins, eleven pins, etc.) is also compatible with five or six bump contact audio plug connectors that meet MIL-DTL-55116 specifications, where a mating connection between the receptacle connector of the invention and an audio plug connector meeting MIL-DTL-55116 specifications can be achieved without any electrical shorting between contact pins and bump contacts (i.e., no contact between a bump contact and any other contact pin other than the corresponding contact pin to which the bump contact is designed to engage with). Thus, the receptacle connector 102 of FIGS. 3-5 is configured to connect with the six bump contact plug connector 40 of FIG. 2 without any electrical shorting occurring between the connectors during the mating connection. This facilitates compatibility of the receptacle connector 102 with standard five or six contact audio plug connectors that meet MIL-DTL-55116 specifications (e.g., for use as an audio connector) as well as additional functionality with plug connectors having additional bump contacts of the invention.

The plug connector of the invention (e.g., the embodiment depicted in FIGS. 6 and 7) can also be configured to connect with five or six pin audio receptacle connectors that meet MIL-DTL-55116 specifications, where a mating connection between the two connectors can be achieved without any electrical shorting between contact pins and bump contacts (i.e., no contact between a bump contact and any other contact pin other than the corresponding contact pin to which the bump contact is designed to engage with). In other words, the eleven bump contact plug connector 140 of FIGS. 6 and 7 can be configured to mate with the six pin receptacle connector depicted in FIG. 1 without any electrical shorting between the connectors during the mating connection.

Figure 2:
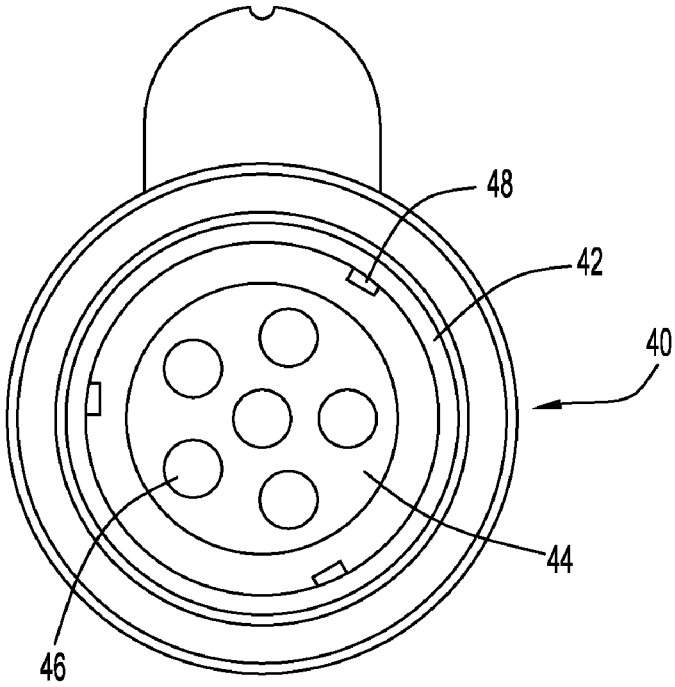
FIG.2 PRIOR ART
FIG. 2 is a view in plan of a conventional six contact bump plug connector that connects with the receptacle connector of FIG. 1.

The design of the connectors of the present invention that allow the addition of electrical contacts without electrical shorting is achieved in a number of different ways including, without limitation, aligning the contacts in suitable positions (such as the locations for contact pins/bump contacts described for the embodiments of FIGS. 3-8) and modifying the cross-sectional dimensions of the contact pins. In particular, the diameters of the contact pins 107, 108, 109 of the eleven pin receptacle connector 102 of FIGS. 3-5 are smaller than diameters of the contact pins 8 of the six pin audio receptacle connector of FIG. 1. The diameters of the contact pins for a standard six pin audio receptacle connector (as shown in FIG. 1) meeting MIL-DTL-55116 specifications are typically about 0.076 inch (about 0.193 cm), whereas the diameters of the eleven pin receptacle connector depicted in FIGS. 3-5 are about 0.050 inch (about 0.127 cm). The diameters of a six contact bump plug connector (as shown in FIG. 2) meeting MIL-DTL-55116 specifications are typically about 0.091 inch (about 0.231 cm), whereas the diameters of the eleven contact bump plug connector depicted in FIGS. 6 and 7 are about 0.070 inch (about 0.178 cm).

Alternatively, the connectors of the present invention can include electrical contacts having different diameters. For example, in an eleven pin receptacle connector, the first set of six pins (e.g., pins 107 and 108 as shown in FIGS. 3-5) can have a larger diameter than the second set of five pins (e.g., pins 109 as shown in FIGS. 3-5).

In addition, the standard five and six pin audio connectors meeting MIL-DTL-55116 specifications are designed such that the plug connector rotates about 18° with respect to the receptacle connector to achieve a mating connection. The connectors of the present invention are designed such that the plug connector rotates less than 18° (for example, the plug connector rotates about 13°) with respect to the receptacle connector to achieve a mating connection.

Other geometric electrical contact configurations for the connectors are also possible, such as the contact configurations for connectors as shown in FIGS. 9, 9A, 10 and 10A. In this embodiment, the second set of contact pins 109-1 of receptacle connector 102-1 and corresponding second set of bump contacts 149-1 of plug connector 140-1 also form a pentagon geometric configuration that is rotated with respect to the pentagon geometric configuration of first set of contact pins 108 and first set of bump contacts 148. However, the second sets of contact pins 109-1 and bump contacts 149-1 are located a smaller radial distance from central contact pin 107 and central bump contact 147 in relation to the second sets of contact pins 108 and bump contacts 148. These connectors are also designed so as to prevent shorting between contacts during mating of the connectors.

Figure 11:
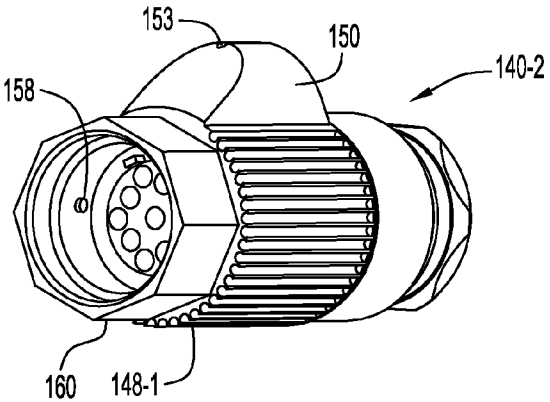
FIG. 11 is a perspective view including the front side of another example embodiment of a plug connector of the present invention which connects with the receptacle connector of FIG. 3.

The plug connector of FIGS. 6 and 7 can also be modified to include a rotatable nut for the outer shell designed to lock the plug connector with the receptacle connector. Referring to FIG. 11, a plug connector 140-2 includes an outer shell 148-1 with a nut 160 that is located at the front end of the plug connector and is rotatable with respect to the remaining outer shell portion of the plug connector. The rotatable nut 160 includes the bayonet pins 158 disposed along interior portions of the nut in similar positions as shown for the plug connector 140 of FIGS. 6 and 7. The outer surface of the rotatable nut can also be knurled to facilitate easy rotation and connection of the nut to the receptacle connector by hand (e.g., without the requirement of a tool).

In this embodiment, the electrical bump contacts are positioned in the same geometric pattern as the previously described plug connector. However, the bump contacts are positioned such that, when the alignment indicator 150/153 of plug connector 140-2 is aligned with the alignment indicator 130 of connector 102, the bump contacts and contact pins are aligned to engage with each other upon mating of the two connectors. Thus, there is no rotation of the inner core and bump contacts of the plug connector 140-2 with respect to the inner core and contact pins of the receptacle connector 102 during mating. Instead, the nut connector 160 of plug connector 140-2 is aligned such that bayonet pins 158 align with the J-slots 110, and the nut 160 is then rotated during mating to engage the bayonet pins within the J-slots and lock the connectors together. The receptacle connector 102 can also be modified to include a notch or groove on an inner peripheral portion of the outer shell 104 that serves as a keyway for a corresponding protrusion on the inner core of the plug connector such that, during mating of the connectors, the key of the plug connector engages with the keyway of the connector which in turn ensures appropriate alignment between contact pins and bump contacts.

The connectors of the present invention are suitable for use as audio connectors for a variety of devices meeting MIL-DTL-55116 specifications (e.g., U.S. military or other U.S. government electronic devices), where the connectors also facilitate the transfer of other signals in addition to audio signals from the device.

Figure 12:
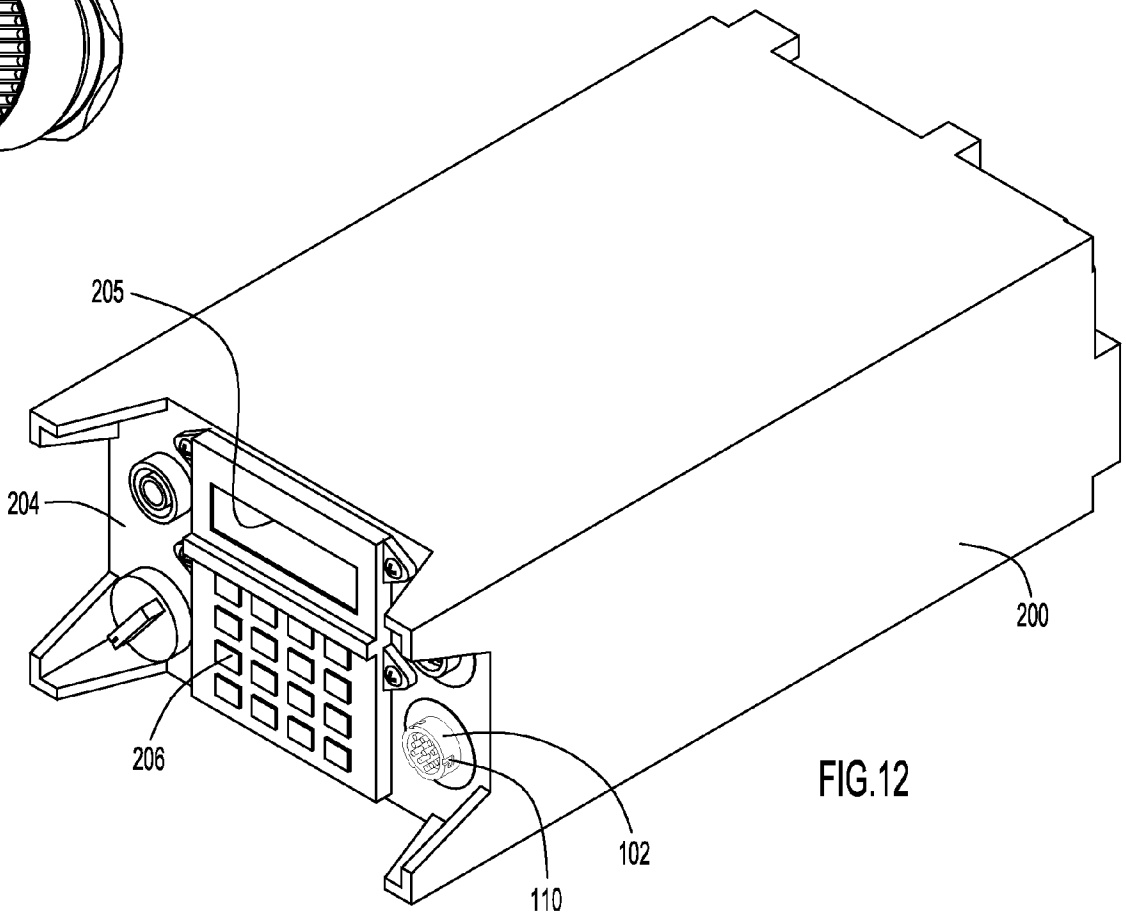
FIG. 12 is an example embodiment of an electronic device including the receptacle connector of FIG. 3.

An example embodiment in which the connectors of the present invention can be used are as audio connectors for communication systems of the U.S. military which employ Single Channel Ground and Airborne Radio System or SINCGARS radio units such as an RT-1523F SINCGARS radio unit as shown in FIG. 12. The radio unit 200 includes a front panel 204 that includes a suitable electronic display 205 and a user input interface including a touch key pad 206 that includes input keys to facilitate control and operability of the radio by a user, as well as a power and control switch and various data ports configured to connect with other components for exchanging data. One of the ports, which is located on the right-hand side of the front face 204 of the unit 200 (when looking at the radio as shown in FIG. 11), is configured as audio receptacle connector 102 which includes eleven electrical contact pins as described above and depicted in FIGS. 3-5. The receptacle connector 102 can be used to connect with a standard plug audio connector including five or six electrical contacts (e.g., such as the plug connector shown in FIG. 2), which facilitates a connection of radio unit 200 to a handset or other auxiliary audio electronic device. In connecting with a standard audio plug connector, the first set of contact pins of the receptacle connector are utilized to transmit audio signals between the radio unit and electronic device.

In addition, the receptacle connector 102 can be connected with another plug connector, such as the types depicted in FIGS. 6-8 or in FIG. 11, to facilitate the transmission of audio and/or other electrical signals (e.g., control signals, RS-232 signals, and/or other data signals) between the radio unit 200 and the auxiliary device. For example, the additional electrical contacts in the connectors can provide a Universal Serial Bus (USB) interface between the radio unit and auxiliary device for exchanging data signals between the two devices. The connectors can also provide an Ethernet interface between two devices. Alternatively, the connectors can facilitate transmission of a power supply (e.g., a low current power source) between two electronic devices. In these embodiments in which both the first and second sets of contact pins of the receptacle connector are used, the first set of contact pins could be used for the transmission of audio signals and the second set of contact pins could be used for the transmission of additional analog or digital signals or for the transmission of power between the radio unit and device.

Thus, the connectors of the present invention facilitate a wide range of connections between an electronic unit and other electronic devices configured for connection and interaction with the electronic unit. The number, pattern and sizes of electrical connecting elements (e.g., contact pins and bump contacts) on a receptacle connector or plug connector maximizes the number of electrical connecting elements that can be disposed within a given area of a connector and further expands the range of applications in which the connector can be used for transmitting analog signals (e.g., radio and/or audio signals), digital signals (e.g., control and/or other data signals), and/or providing electrical power from one unit connected to another unit. Further, the number, pattern and sizes of the electrical connecting elements on a receptacle connector and corresponding plug connector are suitably configured to permit rotation of the plug connector with respect to the receptacle connector during mating of the two connectors while preventing contact and shorting between electrical contacts during the mating process.

Having described exemplary embodiments of connectors to connect electronic devices, variations and changes will be suggested to those skilled in the art in view of the teachings set forth herein. It is therefore to be understood that all such variations, modifications and changes are believed to fall within the scope of the present invention as defined by the appended claims.

What is claimed:

1. A connector for electrically connecting an electronic device to another device, the connector comprising:

an outer shell including a front surface that terminates at a front side of the connector, the front side of the connector being configured to mate with a second connector;

an inner core at least partially disposed within the outer shell and including a front surface that is recessed within the outer shell; and a plurality of electrical connecting elements at least partially disposed within the inner core and extending from the front surface of the inner core, wherein the plurality of electrical connecting elements includes a first set of electrical connecting elements and a second set including at least one electrical connecting element, the first set of electrical connecting elements comprises five connecting elements arranged in a pentagon pattern where each connecting element is located at a point defined by two intersecting lines of the pentagon pattern, and each connecting element of the second set is spaced at a greater radial distance from a center of the inner core in relation to each connecting element of the first set, wherein the first and second sets of electrical connecting elements total eleven electrical connecting elements.

2. The connector of claim 1, wherein the electrical connecting elements of the first and second sets comprise convex bump contacts extending from the front surface of the inner core that are configured to mate with corresponding electrical contacts of the second connector.

3. A connector for electrically connecting an electronic device to another device, the connector comprising:

an outer shell including a front surface that terminates at a front side of the connector, the front side of the connector being configured to mate with a second connector, wherein the outer shell of the connector is configured to fit at least partially within an outer shell of the second connector when the connector and the second connector are connected together, and the outer shell of the connector includes a plurality of J-shaped slots extending transversely from outer surface portions of the outer shell, the plurality of J-shaped slots being configured to engage with pins disposed on portions of the outer shell of the second connector when the connector and the second connector are connected together;

an inner core at least partially disposed within the outer shell and including a front surface that is recessed within the outer shell; and a plurality of electrical connecting elements at least partially disposed within the inner core and extending from the front surface of the inner core, wherein the plurality of electrical connecting elements includes a first set of electrical connecting elements and a second set of electrical connecting elements, the first set of electrical connecting elements comprises five connecting elements arranged in a pentagon pattern where each connecting element is located at a point defined by two intersecting lines of the pentagon pattern, and the electrical connecting elements of the first and second sets comprise electrical contact pins that are configured to mate with corresponding electrical contacts of the second connector.

4. The connector claim 3, wherein the first set of electrical connecting elements further comprises a central connecting element disposed at a location within the pentagon pattern formed by the five connecting elements.

5. The connector of claim 3, wherein the second set of connecting elements comprises five connecting elements arranged in a pentagon pattern where each connecting element is located at a point defined by two intersecting lines of the pentagon pattern.

6. The connector of claim 3, wherein the first set includes five or six electrical connecting elements, and the second set includes five connecting elements.

7. The connector of claim 3, further comprising:

rear electrical connecting elements that extend from a rear side of the outer shell, wherein each rear electrical connecting element is electrically coupled to a corresponding electrical connecting element of the first or second set within the connector, and the rear connecting elements are configured to be electrically coupled to electrical contact elements of a device to which the connector is attached.

8. The connector of claim 3, wherein the connector is configured to mate with the second connector by rotating one of the connectors with respect to the other during mating so as to align and contact the first and second sets of electrical connecting elements with corresponding electrical connecting elements of the second connector, and the first and second sets of electrical elements of the connector are suitably dimensioned and are oriented within the inner core such that no electrical connecting element of the connector contacts any electrical connecting element of the second connector while rotating one connector with respect to the other during mating of the connectors except for the corresponding electrical connecting element of the second connector to which each electrical connecting element of the connector is configured to engage with upon achieving a mating connection between the connectors.

9. The connector of claim 3, wherein a rear side of the outer shell of the connector is configured to connect with an electronic device so as to facilitate the transmission of audio signals and at least one of an analog signal other than an audio signal, a digital signal other than an audio signal, and electrical power between the electronic device and another device connected to the connector.

10. The connector of claim 3, wherein the electrical connecting elements of the first and second sets comprise electrical contact pins that are configured to mate with corresponding electrical contacts of the second connector.

11. The connector of claim 10, wherein at least some of the electrical contact pins are spring biased toward the front side of the connector and are also configured to be pressed away from the front side of the connector upon engagement with corresponding electrical contacts of the second connector.

12. The connector of claim 10, wherein the outer shell of the connector is configured to fit at least partially within an outer shell of the second connector when the first and second connectors are connected together.

13. An electronic device including the connector of claim 3, the electronic device being configured to connect with a second electronic device, via the connector, to facilitate the transmission of audio signals between the electronic devices via the first set of electrical connecting elements of the connector and at least one of analog signals, digital signals, and electrical power between the electronic devices via the second set of at least one electrical connecting element of the connector.

14. The electronic device of claim 13, wherein the electronic device comprises a radio communication device.

15. A connector for electrically connecting an electronic device to another device, the connector comprising:

an outer shell including a front surface that terminates at a front side of the connector, the front side of the connector being configured to mate with a second connector;

an inner core at least partially disposed within the outer shell and including a front surface that is recessed within the outer shell; and a plurality of electrical connecting elements at least partially disposed within the inner core and extending from the front surface of the inner core, wherein the plurality of electrical connecting elements includes a first set of electrical connecting elements and a second set including at least one electrical connecting element, the first set of electrical connecting elements comprises five connecting elements arranged in a pentagon pattern where each connecting element is located at a point defined by two intersecting lines of the pentagon pattern, and each connecting element of the second set is spaced at a greater radial distance from a center of the inner core in relation to each connecting element of the first set;

wherein the electrical connecting elements of the first and second sets comprise convex bump contacts extending from the front surface of the inner core that are configured to mate with corresponding electrical contacts of the second connector, the connector is configured to connect with the second connector by rotation of the connector with respect to the second connector by a rotational angle less than 18°, and the convex bump contacts are arranged on the inner core such that, upon rotation of the connector with the second connector, the convex bump contacts engage the corresponding electrical contacts of the second connector.

16. The connector of claim 15, wherein the outer shell of the connector is configured to fit around at least part of the second connector when the connector and the second connector are connected together.

17. The connector of claim 15, wherein the outer shell includes a rotatable nut disposed at the front end of the connector that facilitates mating of the connector with the second connector.

18. A method of connecting a first connector with a second connector to transfer electrical signals through the connectors to electronic devices coupled with the connectors, wherein the first connector comprises an outer shell including a front surface that terminates at a front side of the first connector, an inner core at least partially disposed within the outer shell and including a front surface that is recessed within the outer shell, and a plurality of electrical contact pins at least partially disposed within the inner core and extending from the front surface of the inner core, the plurality of electrical contact pins including a first set of contact pins and a second set of at least one contact pin, the first set of contact pins comprising five contact pins arranged in a pentagon pattern where each contact pin is located at a point defined by two intersecting lines of the pentagon pattern, and the second connector comprises an outer shell including a front surface that terminates at a front side of the second connector, an inner core at least partially disposed within the outer shell and including a front surface that is recessed within the outer shell, and a plurality of electrical convex bump contacts at least partially extending from the front surface of the inner core, the plurality of electrical convex bump contacts including a first set of bump contacts, the first set of bump contacts comprising five bump contacts arranged in a pentagon pattern where each bump contact is located at a point defined by two intersecting lines of the pentagon pattern, the method comprising:

inserting the front side of the outer shell of the first connector into the outer shell of the second connector;

aligning the second connector with the first connector such that the pentagon pattern of bump contacts of the second connector is offset from the pentagon pattern of contact pins of the first connector; and rotating one of the first connector and the second connector in relation to the other of the first connector and the second connector to mate the connectors together and engage each contact pin of the first connector with a corresponding bump contact of the second connector;

wherein:

each contact pin of the first connector engages and achieves an electrical contact with only the corresponding bump contact and no other bump contact of the second connector during rotational movement of one of the first connector and the second connector to achieve mating between the first and second connectors; and the one of the first connector and the second connector is rotated to an angle of less than 18° in relation to the other of the first connector and the second connector to mate the connectors together and engage each contact pin of the first connector with a corresponding bump contact of the second connector.

19. The method of claim 18, wherein the second connector further includes a second set of bump contacts.

20. The method of claim 19, wherein the second set of contact pins of the first connector comprises five contact pins arranged in a pentagon pattern where each contact pin is located at a point defined by two intersecting lines of the pentagon pattern, and the second set of bump contacts of the second connector comprises five bumps contacts arranged in a pentagon pattern where each bump contact is located at a point defined by two intersecting lines of the pentagon pattern.

21. The method of claim 19, wherein the first connector is connected with a first electronic device and the second connector is connected with a second electronic device, and the method further comprises:

after mating of the first connector with the second connector, transmitting audio signals between the first and second electronic devices between the first and second devices via the first set of contact pins and the first set of bump contacts, and transmitting at least one of analog signals, digital signals and electrical power between the first and second devices via the second set of contact pins and the second set of bump contacts.

22. The method of claim 21, wherein the first electronic device comprises a radio communication unit.

* * * * *

UNITED STATES PATENT AND TRADEMARK OFFICE

CERTIFICATE OF CORRECTION

PATENT NO. : 8,052,480 B2
APPLICATION NO. : 12/370630
DATED : November 8, 2011
INVENTOR(S) : Timothy Glenn Hauser It is certified that error appears in the above-identified patent and that said Letters Patent is hereby corrected as shown below:

Column 11, line 32, replace "The connector claim 3" with -- The connector of claim 3 --.

Signed and Sealed this
Twenty-fourth Day of April, 2012

David J. Kappos

David J. Kappos
*Director of the United States Patent and Trademark Office*